US011034484B2

(12) United States Patent
Pedmo et al.

(10) Patent No.: US 11,034,484 B2
(45) Date of Patent: Jun. 15, 2021

(54) STACKABLE CONTAINER WITH SPOUT

(71) Applicant: Plastipak Packaging, Inc., Plymouth, MI (US)

(72) Inventors: Marc A. Pedmo, Litchfield, MI (US); Mike Sainato, Wadsworth, OH (US); Andrew Fischer, Medina, OH (US); David Greig, Massillon, OH (US); Matt Kinkoph, Lagrange, OH (US); Kevin Yerkey, Wadsworth, OH (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 15/441,684

(22) Filed: Feb. 24, 2017

(65) Prior Publication Data

US 2017/0247142 A1 Aug. 31, 2017

Related U.S. Application Data

(60) Provisional application No. 62/300,379, filed on Feb. 26, 2016.

(51) Int. Cl.
*B65D 21/02* (2006.01)
*B65D 1/02* (2006.01)

(52) U.S. Cl.
CPC ..... *B65D 21/0231* (2013.01); *B65D 1/023* (2013.01); *B65D 1/0207* (2013.01); *B65D 1/0292* (2013.01)

(58) Field of Classification Search
CPC .... B65D 1/0207; B65D 1/023; B65D 1/0292; B65D 21/0231; B65D 5/0035; B65D 5/2004; B65D 21/02; B65D 21/0234; B65D 21/0223; B65D 81/361; B65D 21/0238
See application file for complete search history.

(56) References Cited

U.S. PATENT DOCUMENTS 2,077,027 A * 4/1937 Torras ..... B65D 21/0231 206/508
2,517,457 A * 8/1950 Allen ..... A61J 9/005 215/11.3
3,179,323 A * 4/1965 Miller ..... B65D 1/0292 220/23.87

(Continued)

FOREIGN PATENT DOCUMENTS

DE 9213289 U1 * 12/1992 ..... B65D 1/06
DE 202012005879 U1 * 8/2012 ..... B65D 1/0223

(Continued)

OTHER PUBLICATIONS

International Search Report, PCT/IB17/51097, dated Jun. 19, 2017.

*Primary Examiner* — Vishal Pancholi
*Assistant Examiner* — Bob Zadeh
(74) *Attorney, Agent, or Firm* — Fishman Stewart PLLC

(57) ABSTRACT

A stackable plastic container includes a base with a recessed portion; a sidewall portion; a shoulder; and a spout configured to dispense contents. The shoulder and spout may be configured to move downwardly in a vertical direction toward the base. In embodiments, the recessed portion may be configured to receive or cover at least a portion of a spout of an identical container. In embodiments, one or more containers in a retracted configuration may be stacked.

21 Claims, 8 Drawing Sheets

(56) References Cited

U.S. PATENT DOCUMENTS 3,326,421 A * 6/1967 Peace ..... B29C 66/112 222/143
4,082,827 A * 4/1978 Chlystun ..... B29C 49/482 222/529
4,848,601 A * 7/1989 Reil ..... B65D 47/103 222/528
4,877,142 A * 10/1989 Doering ..... B65D 1/0223 215/382
5,348,173 A * 9/1994 Norwood ..... B65D 1/0292 206/509
5,927,499 A 7/1999 Vesborg
6,588,612 B1 7/2003 Dorn et al.
6,932,228 B1 8/2005 Darr et al.
7,926,243 B2 * 4/2011 Kelley ..... B65B 61/24 53/440
8,065,857 B2 11/2011 Rivera et al.
8,678,188 B2 * 3/2014 Larsen ..... B65D 21/0231 206/503
9,278,781 B1 3/2016 Boldis
9,725,201 B2 * 8/2017 Derrien ..... B65D 21/0231
2004/0163986 A1 * 8/2004 Pinyot ..... B65D 21/023 206/428
2005/0230883 A1 10/2005 Higuchi
2007/0045213 A1 3/2007 Voss et al.
2007/0278255 A1 * 12/2007 Pantelleria ..... B65D 11/04 222/529
2009/0045157 A1 * 2/2009 Panchal ..... B65D 21/0204 215/10
2009/0266782 A1 10/2009 Lane
2010/0199609 A1 * 8/2010 Rivera ..... B65D 21/0231 53/447
2011/0132790 A1 6/2011 Dorn
2013/0213927 A1 * 8/2013 Hendrickson ..... B65D 23/00 215/383
2014/0374298 A1 * 12/2014 Touchet ..... B65D 21/0231 206/432
2015/0298847 A1 * 10/2015 Derrien ..... B65D 21/0231 215/40
2016/0200495 A1 * 7/2016 Saito ..... B65D 21/0231 206/499
2017/0247142 A1 * 8/2017 Pedmo ..... B65D 1/0207

FOREIGN PATENT DOCUMENTS

DE 202012005879 U1 * 8/2012 ..... B65D 1/0223
EP 0522326 A1 * 1/1993 ..... B65D 37/00
EP 2060502 A1 * 5/2009 ..... B65D 11/08
JP 2001-199443 A 7/2001
JP 2014-125236 A 7/2014
JP 2014125236 A * 7/2014
WO WO-2001/62612 A1 8/2001

* cited by examiner

STACKABLE CONTAINER WITH SPOUT

CROSS-REFERENCE TO RELATED APPLICATION

This application claims the benefit to U.S. Provisional Application No. 62/300,379, filed Feb. 26, 2016, the entire disclosure of which is incorporated herein by reference.

TECHNICAL FIELD

The present invention relates to improved containers including, without limitation, stackable plastic containers having a spout.

BACKGROUND

Various "stackable" molded containers are known. Examples of stackable plastic containers include U.S. Pat. Nos. 8,069,986 and 6,932,228. Such containers can be used to store a variety of goods, including water, cooking oils, and various other products and contents.

Among other things, it can be desirable to provide a plastic container that can be stacked effectively and efficiently, for storage and/or transportation. It can further be desirable to provide a stackable container that includes a spout that is at least partially retractable, i.e., movable in an up-down direction. It can yet further be desirable to provide a container that is aesthetically pleasing and/or is made from a desired polymer material, such as, without limitation, polyethylene terephthalate (PET).

SUMMARY

A stackable plastic container includes a base with a receiving portion; a sidewall portion; a shoulder; and a spout configured to dispense contents. The shoulder and spout may be configured to move downwardly in a vertical direction toward the base, and the receiving portion may be configured to receive a spout of an identical container. In embodiments, one or more containers in a retracted configuration may be stacked.

BRIEF DESCRIPTION OF THE DRAWINGS

Embodiments of the disclosure will now be described, by way of example, with reference to the accompanying drawings, wherein.

DETAILED DESCRIPTION

Reference will now be made in detail to embodiments of the present disclosure, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as described herein and in any appended claims.

Figure 1A:
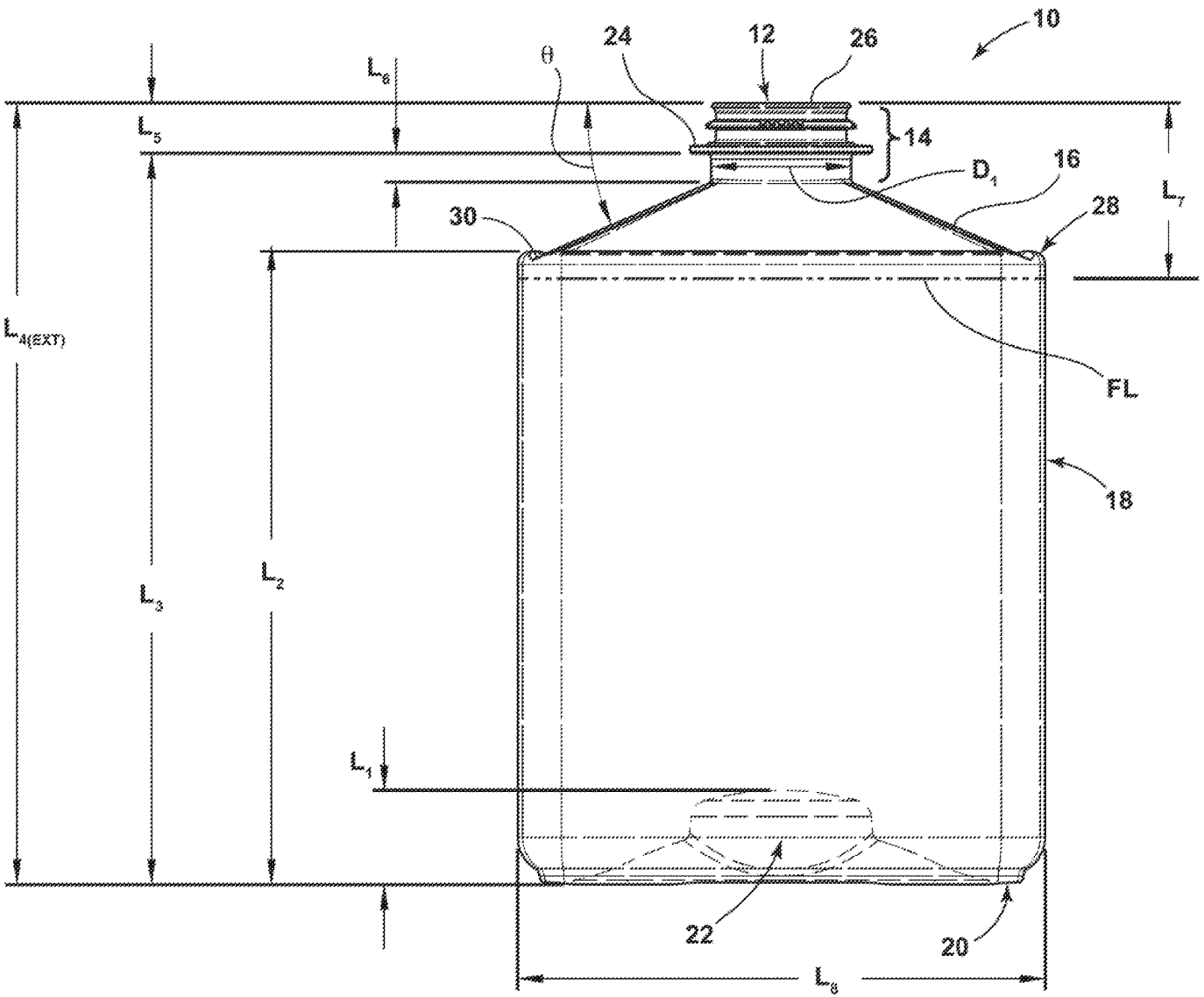
FIG. 1A is a front elevational view of an embodiment of a stackable plastic container that incorporates features/teachings of the present disclosure.

With reference to FIG. 1A, a front elevational view of an embodiment of a plastic container 10 that incorporates features/teachings of the present disclosure is generally illustrated. The container 10 includes an opening 12 that can serve to fill and/or dispense container contents, a neck portion (which may also be referred to as a "spout") 14, a shoulder 16, sidewall portion 18, and a base 20.

In embodiments, the plastic container 10 may comprise polyethylene terephthalate (PET). However, the present teachings are not limited to a specific plastic or polymer material and, with other embodiments, the container may be comprised of various other polymers known in the field of container manufacture including, for example and without limitation, polyethylene (PE), polypropylene (PP), and combinations and blends of two or more polymers.

The base 20 of the container 10 may include a recessed portion 22 that extends upwardly into the body of the container. As generally illustrated in FIG. 1A, the recessed portion 22 may extend a distance, $L_1$, upwardly from a support surface, and the recessed portion 22 may be configured, e.g. sized and/or shaped, to receive or cover a spout 14 of a similar container, as well as potentially also receiving or covering a portion of a shoulder 16 of a similar container.

In embodiments, the neck or spout 14 may additionally include a support flange 24 and/or threads 26. Also, a fill line FL is generally designated. The fill line FL may represent an intended vertical fill line associated with intended contents. The intended contents may, for example, comprise a liquid. For example, and without limitation, in the illustrated embodiment the fill line FL may represent a fill line associated with 500±10 mL of liquid contents.

Figure 2B:
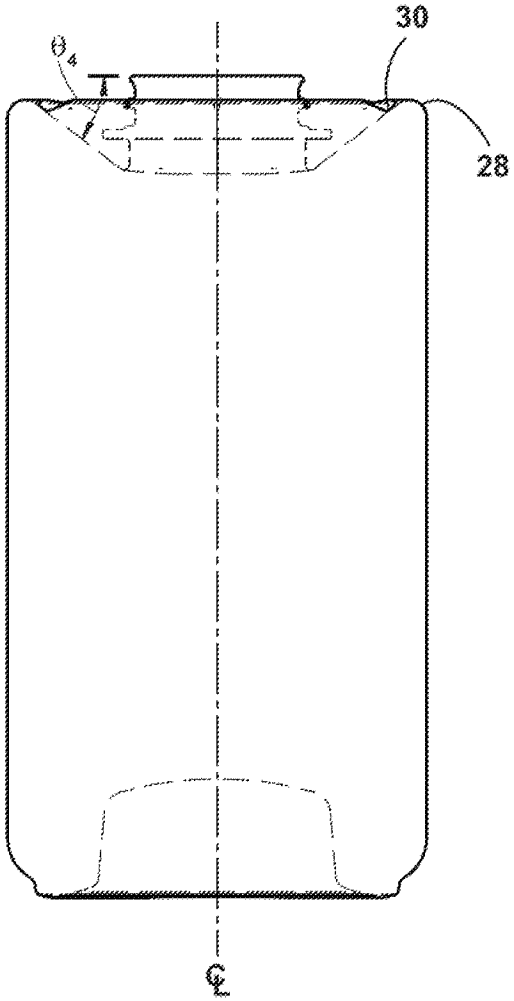
FIG. 2B is a side elevational view of the embodiment of the plastic container illustrated in FIG. 2A, shown with the spout in a retracted configuration.
Figure 2A:
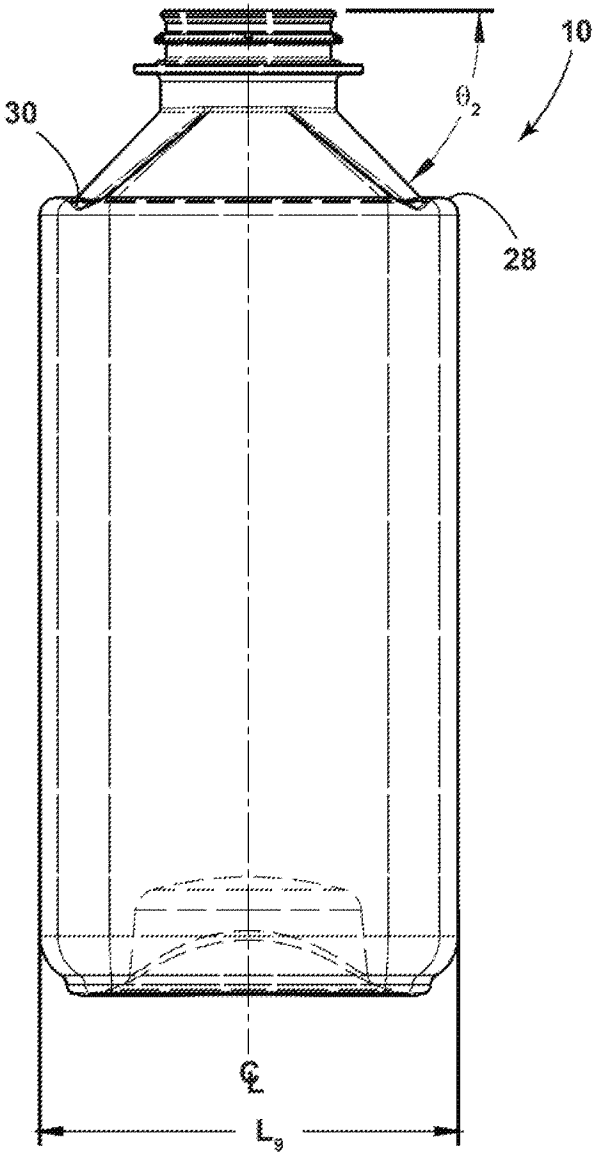
FIG. 2A is a side elevational view of an embodiment of a plastic container as generally illustrated in FIG. 1.

With reference to FIGS. 1A and 2A, an embodiment of a container with aspects of the present disclosure may include the following dimensions:

- $L_2$—distance from the bottom of the base (or the support surface) to the top (or apex) of the sidewall portion;
- $L_3$—distance from the bottom of the base (or the support surface) to the support flange;
- $L_{4(EXT)}$—distance from the bottom of the base (or the support surface) to the top of the neck or spout (the neck or spout shown extended);
- $L_5$—distance between the support flange and the top of the neck or spout;

$L_6$—distance between the support flange and the top of the shoulder;

$L_7$—may generally represent a distance from the top of the neck or spout to a fill line;

$L_8$—width of the container viewed across the front;

$L_9$—width of the container viewed across the side view;

$D_1$—a diameter of a portion of the neck or spout at or just above the shoulder; and $\Theta$—angle between a horizontal line extending from the top of the neck or spout and a line taken along the shoulder.

By way of example only, and without limitation, an embodiment of a container may have the following dimensions:

$L_1$—0.650 in. (16.51 mm)
$L_2$—4.376 in. (111.15 mm)
$L_3$—5.053 in. (128.35 mm)
$L_{4(EXT)}$—5.400±0.50 in. (137.16±1.27 mm)
$L_5$—0.347 in. (8.81 mm)
$L_6$—0.200 in. (5.08 mm)
$L_7$—1.215 in. (30.86 mm)
$L_8$—3.650±0.060 in. (92.71±1.52 mm);
$L_9$—2.300±0.060 in. (58.41±1.52 mm); and
$D_1$—0.965 in. (24.50 mm)
$\Theta$—23.2±5 degrees
$\Theta_2$—45.9±5 degrees While some of the dimensions associated with the exemplary embodiment depicted in FIGS. 1A and 2A include plus-minus (tolerance-type) ranges, it is understood that even the noted dimensions with no stated plus-minus ranges or tolerances, may have ranges or tolerances similar to those noted with other dimensions (e.g., $L_{4(EXT)}$ or $L_8$).

Figure 3:
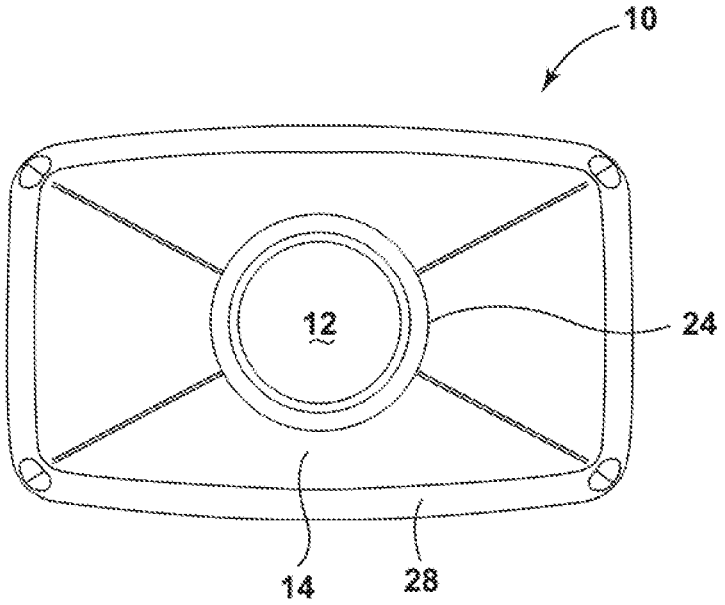
FIG. 3 is a top plan view of the embodiment of a plastic container as generally illustrated in FIG. 1A.
Figure 4:
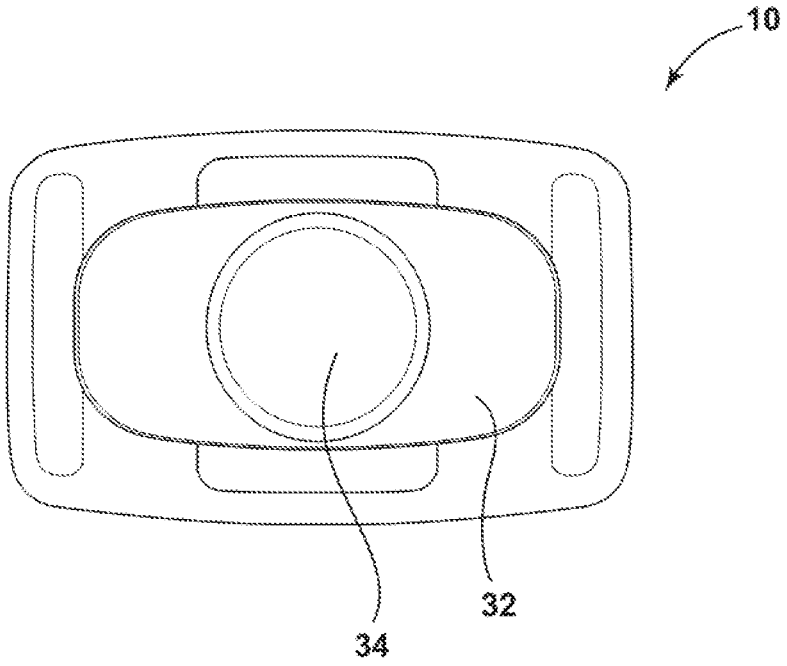
FIG. 4 is a bottom view of the embodiment of a plastic container as generally illustrated in FIG. 1A.
Figure 5:
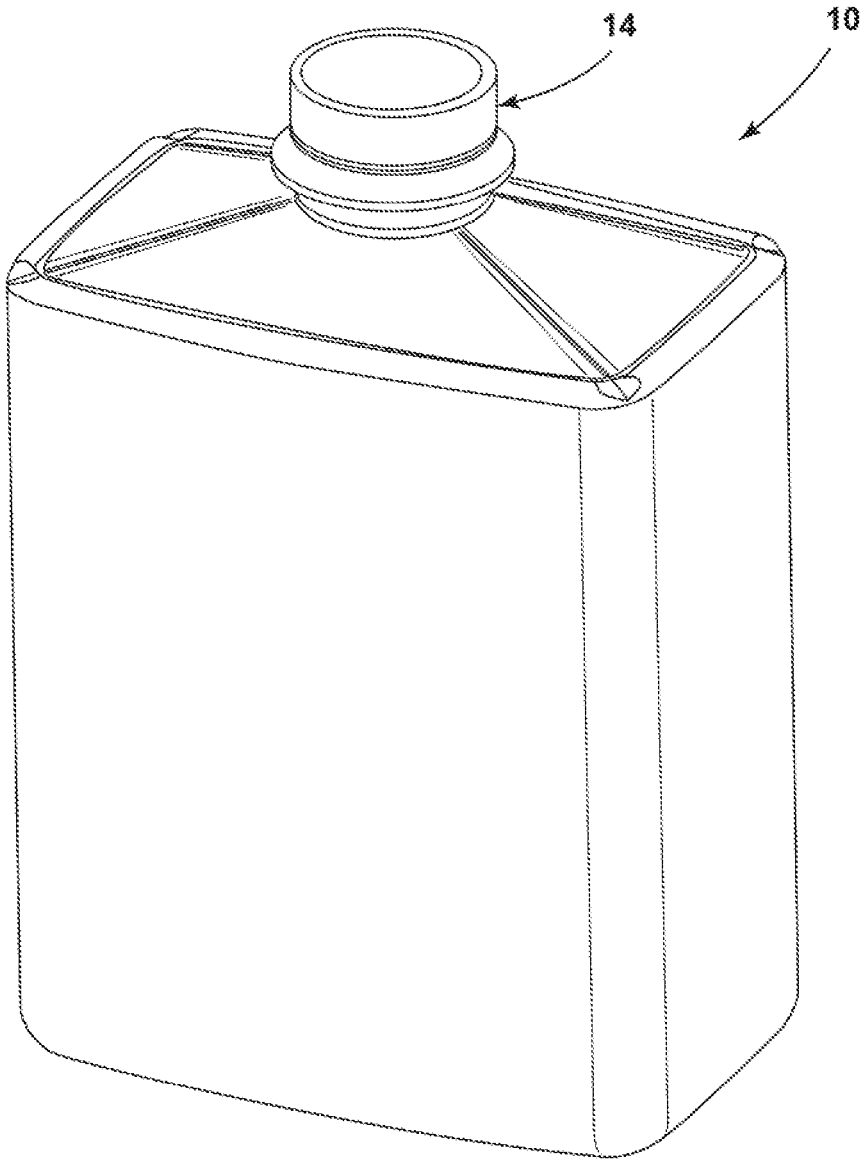
FIG. 5 is front-side-top isometric view of a plastic container of the type generally illustrated in FIG. 1A, depicting the spout in an extended position.

FIGS. 1A, 2A and 5 generally illustrate embodiments of a container 10 with a spout 14 shown in an extended configuration. FIGS. 3 and 4 generally illustrate top plan and bottom views of a container as shown in FIGS. 1A and 2A.

Figure 1B:
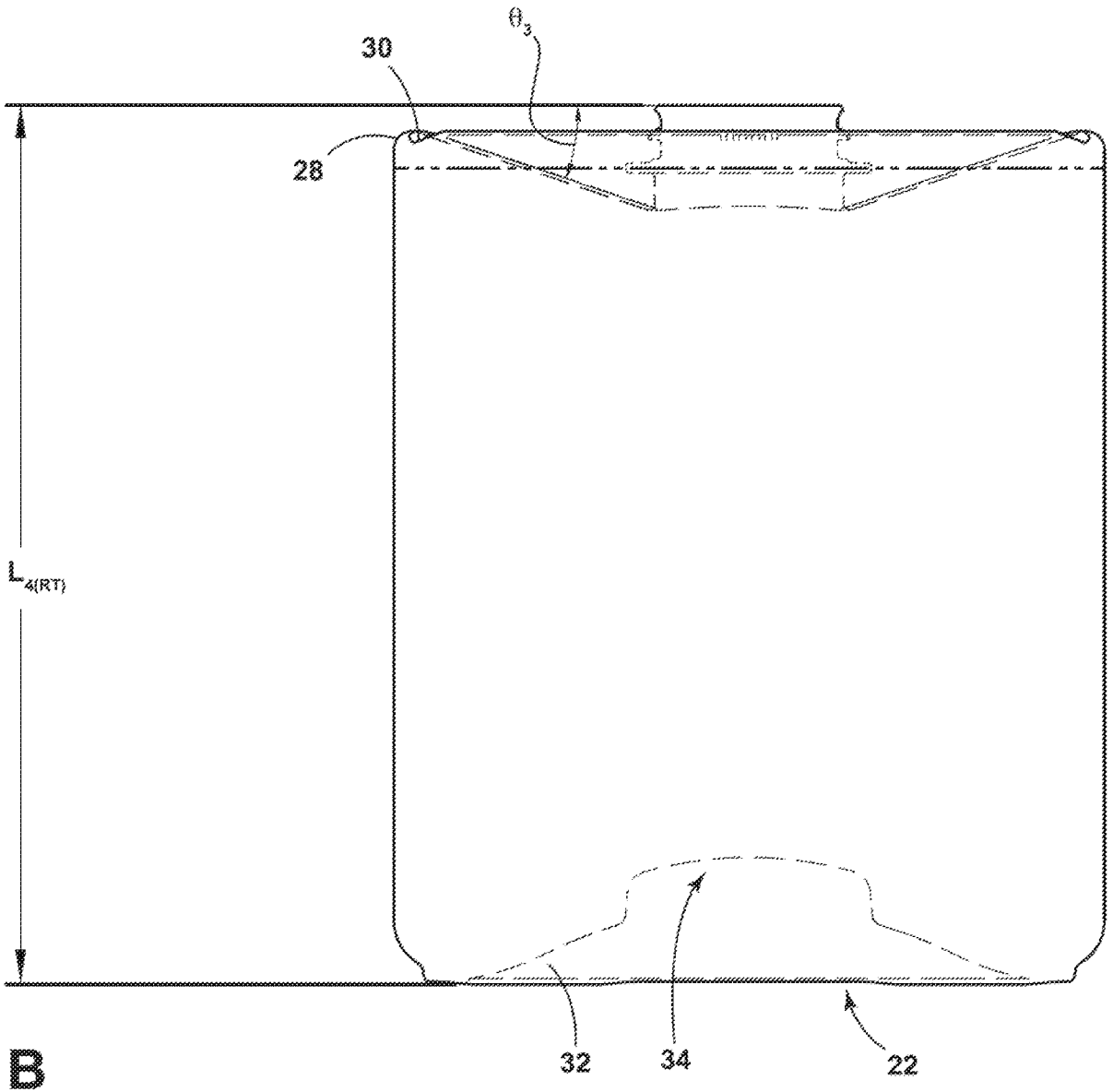
FIG. 1B is a front elevational view of an embodiment of the plastic container illustrated in FIG. 1A, shown with the spout in a retracted configuration.
Figure 6:
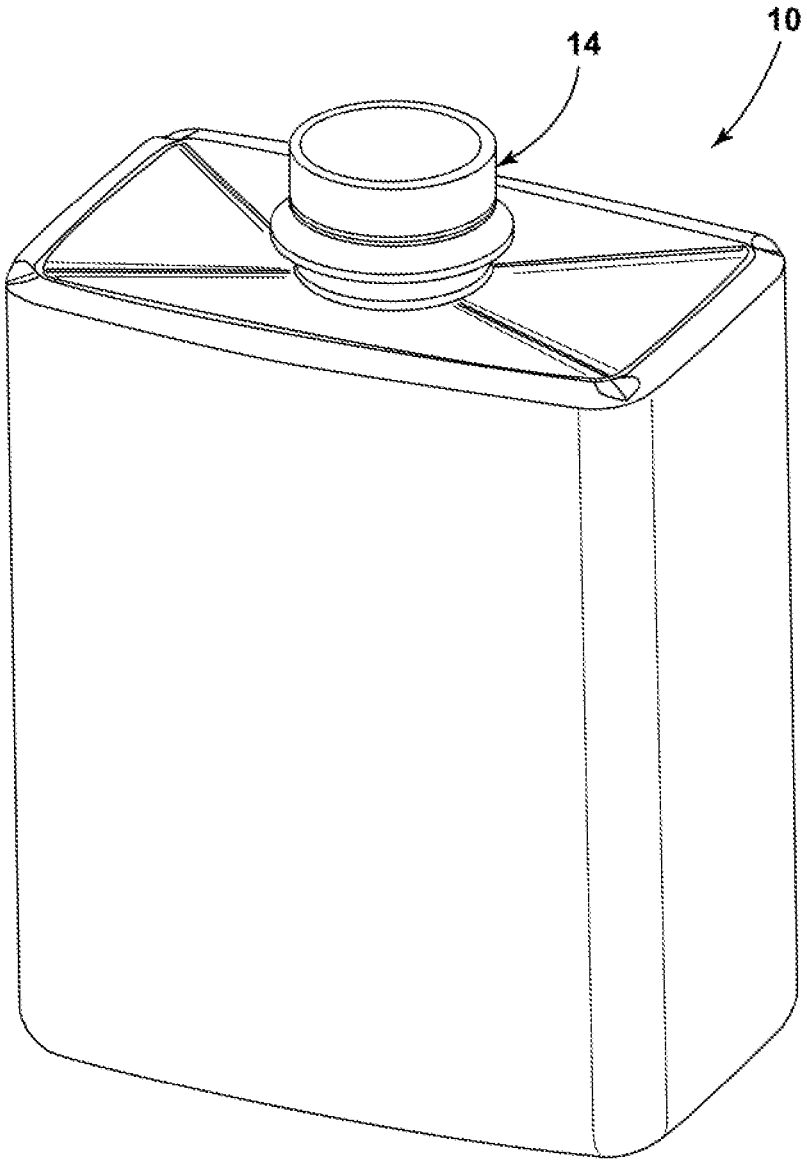
FIG. 6 is front-side-top isometric view of a plastic container, of the type generally illustrated in FIG. 5, which generally depicts the spout in a retracted or non-extended position.

FIGS. 1B, 2B and 6 generally illustrate similar embodiments to those shown in connection with FIGS. 1A, 2A and 5, respectively; however, the spout 14 is instead shown in a retracted or non-extended configuration. A center line CL, which runs centrally through the opening 12 and spout 14, is illustrated in FIGS. 2A and 2B.

Turning specifically to FIGS. 1B and 2B, several dimensions differ from FIGS. 1A and 2A. For instance, length $L_{4(RT)}$—i.e., the distance from the bottom of the base (or the support surface) to the top of the neck or spout (the neck or spout shown retracted) is less than the prior related length $L_{4(EXT)}$. Also, angles $\Theta_3$ and $\Theta_4$ (which are respectively related to angles $\Theta$ and $\Theta_2$ shown in FIGS. 1A and 2A) extend downwardly from a horizontal line extending from the top of the neck or spout and a line taken along the shoulder in the respective views. Among other things, the angles shown in FIGS. 1B and 2B help illustrate how the shoulder 16 has inverted and the spout 14 has retracted. That retraction, among other things, decreases the overall vertical height of the container 10—which can be generally accounted for in the reduced height ($\Delta H$) calculated from the decrease from $L_{4(EXT)}$ to $L_{4(RT)}$. For reference to the prior noted example, and without limitation, $L_{4(RT)}$ may comparatively be 4.508±0.050 in. (114.51±1.27 mm), $\Theta_3$ may be 18.4±5 degrees, and $\Theta_4$ may be 37.6±5 degrees. So, for the illustrated non-limiting example, $\Delta H$ (or $L_{4(EXT)}$ minus $L_{4(RT)}$) would be approximately 0.892 in. (22.65 mm)—e.g., a reduction of more than 16 percent of overall container height. For example, and without limitation, a 500 mL container with a spout in an extended configuration (e.g., FIGS. 1A and 2A) might weigh 28±0.6 grams and might have an overflow of 555±13 mL (18.8±0.44 fl oz), and a similar container with a spout in a retracted configuration (e.g., FIGS. 1B and 2B) might have an overflow of 510±13 mL (17.2±0.44 fl oz).

As generally illustrated in FIGS. 1A, 1B, 2A, and 2B, at the upper vertical end, the sidewall portion 18 may include a ridge 28. The ridge 28, which may be rounded or curved, may include a declining portion 30 which extends downwardly from an uppermost portion, or apex, of the ridge 28 to a where the declining portion 30 meets the shoulder 16.

Figure 7:
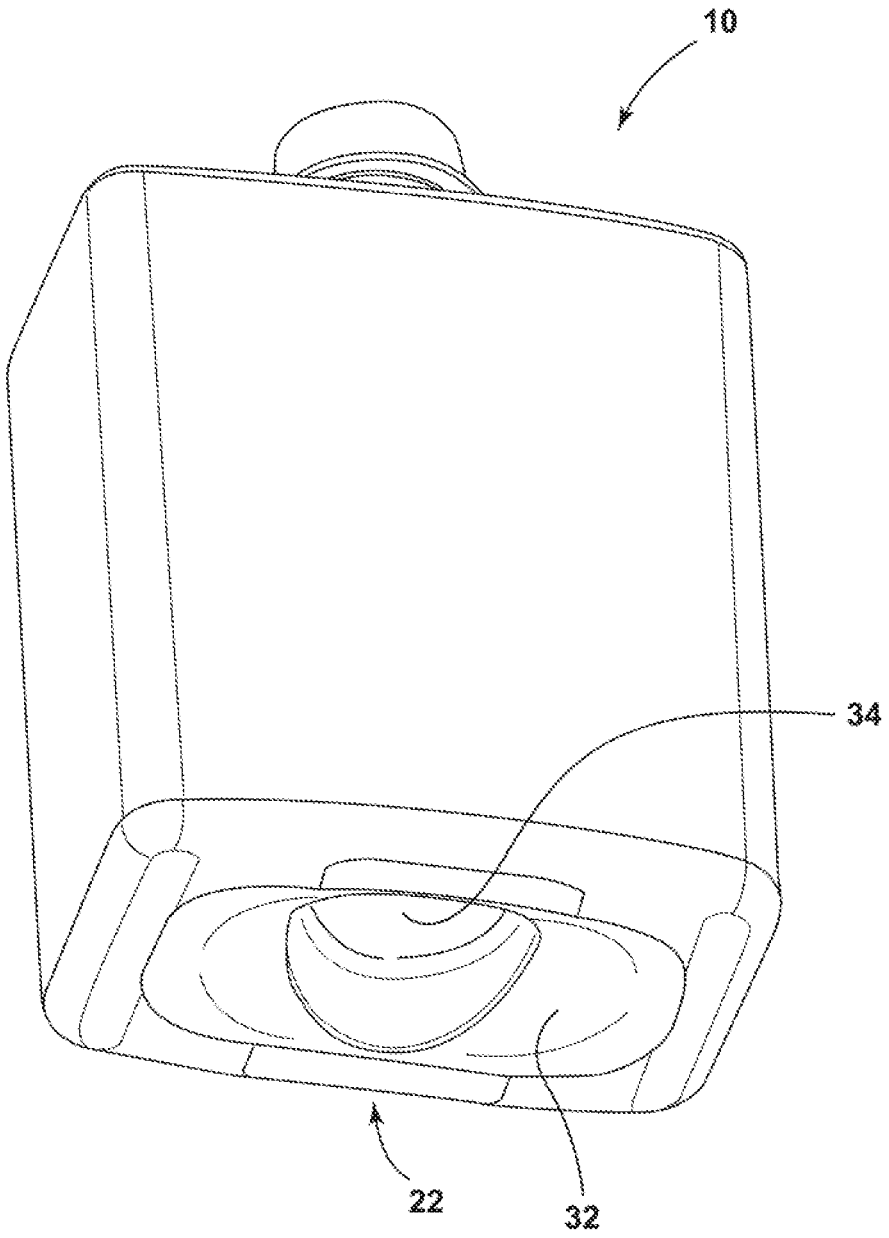
FIG. 7 is a front-side-bottom isometric view of an embodiment of a plastic container, of the type generally illustrated in FIG. 1A.

Also, as generally illustrated in FIG. 1B, the recessed portion 22, which extends upwardly into the body of the container, may include a shallow recess portion 32 and a comparatively deeper recess portion 34. As additionally generally illustrated in FIGS. 1B, 4 and 7, a shallow recess portion may have a generally oblong or oval shape (from a bottom plan perspective) and my taper upwardly to a more central portion of the recessed portion 22, where a deeper recess portion 34 is provided. In embodiments, such as generally illustrated, the deeper recess portion 34 may be more circular (from a bottom plan perspective) and may extend further vertically—for example, to a level such as identified in connection with $L_1$ in FIG. 1A. The deeper recess portion may also be configured to receive or accommodate at least an upper portion of a spout 14 associated with a similar container.

Figure 8:
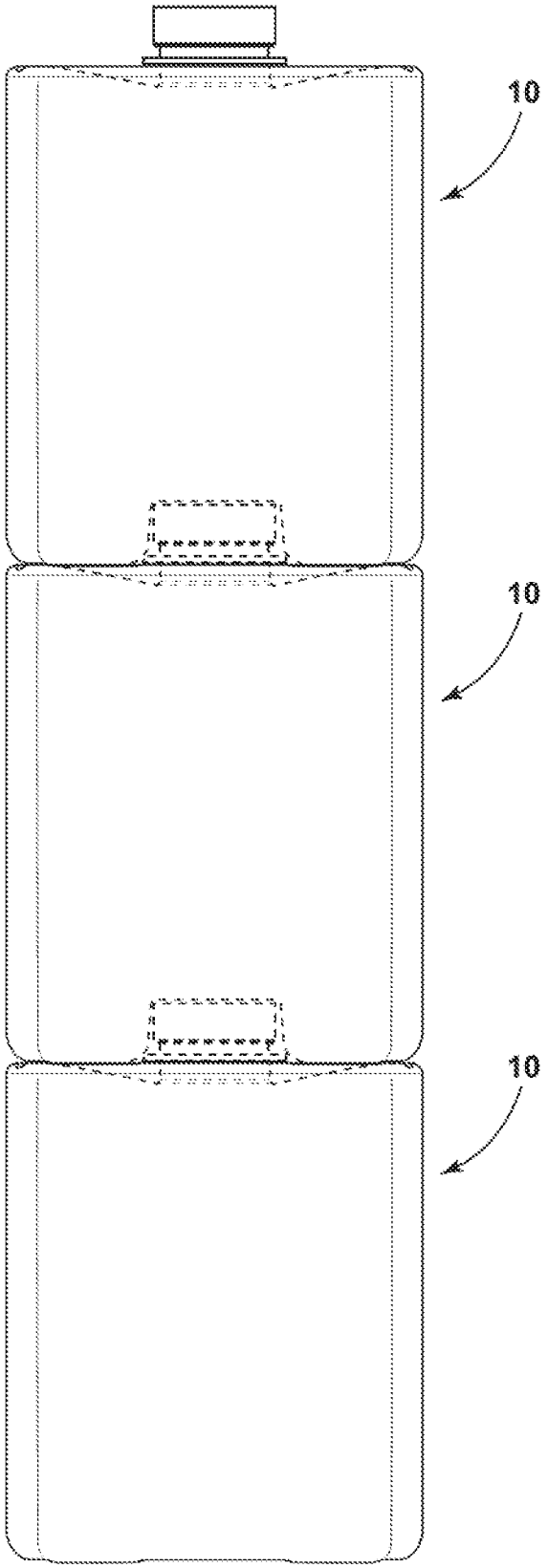
FIG. 8 is a front elevational view that generally illustrates embodiments of plastic containers that are shown in a stacked configuration.

FIG. 8 generally illustrates how a plurality of containers, which incorporate features of the present disclosure, may be provided in a stacked configuration. As generally shown, a container 10 may be provided or manipulated into a retracted configuration (for example, as generally shown in FIGS. 1B, 2B, or 6). With an upper container resting on a lower container, a spout 14 of a lower container may extend upwardly into the recessed portion 22 of the upper container. As generally illustrated in FIG. 8, the height associated with the lower container may be reduced in the "stacked" configuration to a dimension that is at or about dimension $L_2$—i.e., the distance from the bottom of the base (or the support surface) to the top (or apex) of the sidewall portion. So, for example and without limitation, a 500 mL container 10 which may have an extended overall vertical height $L_{4(EXT)}$ of about 5.400 in. (137.16 mm) may have a "stacked" height of approximately 4.376 in. (111.15 mm)—less than one inch or less than 19 percent the extended height. Based on the material/polymer properties and unique configuration/dimensions disclosed, when the container is separated from the stacked configuration, the spout may again be extended as desired to improve dispensing of contents. Moreover, the spout may be extended and retracted multiple times as desired.

While various specific dimensions, tolerances, and notations are included with reference to embodiments of containers disclosed in the drawings included with this disclosure, such dimensions, tolerances, and notations are intended to be exemplary only, i.e., to assist in the understanding of the features and teachings of the present disclosure, and such dimensions, tolerances, and notations set forth in the drawings are not intended to limit the disclosure.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims and their equivalents.

What is claimed is:

1. A stackable plastic container comprising:

a base including a recessed portion;

a sidewall portion including a ridge at an upper vertical end of the sidewall portion;

a shoulder; and a spout with an opening;

wherein, from a top plan view, the sidewall portion is substantially rectangular, having a first pair of opposing sides and a second pair of opposing sides, the first pair of opposing sides having a width greater than a width of the second pair of opposing sides; the shoulder extends from the sidewall portion to the spout from the first pair of opposing sides at a different angle than the second pair of opposing sides; the shoulder and spout are movable downwardly from the ridge in a vertical direction toward the base; and the recessed portion extends upwardly into the container and is configured to receive a spout and a portion of a shoulder of an identical container.

2. The stackable plastic container of claim 1, wherein the recessed portion is configured to receive or cover a substantial portion of a shoulder of an identical container.

3. The stackable plastic container of claim 1, wherein a line taken along the shoulder is provided at an angle with respect to a horizontal line extending from a top of the spout.

4. The stackable plastic container of claim 3, wherein, when the spout is in an extended configuration, the angle extends upwardly toward a center line of the container, and, when the spout is in a retracted or non-extended configuration, the angle extends downwardly toward the center line of the container.

5. The stackable plastic container of claim 3, wherein, when the spout is in an extended configuration, the angle extending upwardly from the second pair of opposing sides toward a center line of the container is 23.2 degrees±5 degrees, and, when the spout is in the extended configuration, the angle extending upwardly from the first pair of opposing sides toward the center line of the container is 45.9 degrees±5 degrees.

6. The stackable plastic container of claim 1, wherein, when the spout is in a retracted or non-extended configuration a vertical height of the container is at least about 16 percent less than the vertical height of the container when the spout is in a fully extended configuration.

7. The stackable plastic container of claim 1, wherein the sidewall portion includes a ridge at an upper vertical end of the sidewall portion.

8. The stackable plastic container of claim 7, wherein the ridge is rounded or curved.

9. The stackable plastic container of claim 7, wherein the ridge includes a declining portion that extends downwardly from an uppermost portion or apex of the ridge to the shoulder.

10. The stackable plastic container of claim 1, wherein the recessed portion includes a shallow recess portion to receive the at least a portion of the shoulder, and a deeper recess portion to receive the spout.

11. The stackable plastic container of claim 10, wherein the shallow recess portion has a generally oblong or oval shape, viewed from a bottom plan view.

12. The stackable plastic container of claim 10, wherein the shallow recess portion tapers upwardly to a more central portion of the recessed portion, where the deeper recess portion extends further vertically upward.

13. The stackable plastic container of claim 12, wherein the deeper recess portion is substantially circular, viewed from a bottom plan view.

14. The stackable plastic container of claim 1, wherein when in a stacked configuration with said identical container, the container has a stacked height of less than 19 percent of an extended height of the container.

15. The stackable plastic container of claim 1, including a support flange.

16. The stackable plastic container of claim 1, wherein the spout includes threads.

17. The stackable plastic container of claim 1, wherein the container is comprised of polyethylene terephthalate (PET).

18. The stackable plastic container of claim 1, wherein the container is comprised of polyethylene (PE).

19. The stackable plastic container of claim 1, wherein the container is comprised of polypropylene (PP).

20. The stackable plastic container of claim 1, wherein the container is configured to hold at least 500±10 mL of liquid contents in a stacked configuration.

21. A stackable plastic container comprising:

a base including a recessed portion;

a substantially rectangular sidewall portion including a ridge at an upper vertical end of a sidewall portion, the sidewall portion having a first pair of opposing sides and a second pair of opposing sides, the first pair of opposing sides having a width greater than a width of the second pair of opposing sides;

a spout with an opening; and a shoulder comprising four portions, each of the four portions disposed between the sidewall portion and the spout at an angle relative to a horizontal plane across a top of the opening of the spout, the angle of a portion of the shoulder between the first pair of opposing sides and the spout is less than the angle of the portion of the shoulder between the second pair of opposing sides and the spout;

wherein the shoulder and spout are movable downwardly from the ridge in a vertical direction toward the base and in a vertical direction away from the base; and the recessed portion extends upwardly into the container and is configured to receive a spout and at least a portion of a shoulder of another container.

* * * * *